US007939798B2

(12) United States Patent
Li et al.

(10) Patent No.: US 7,939,798 B2
(45) Date of Patent: May 10, 2011

(54) TANDEM IONIZER ION SOURCE FOR MASS SPECTROMETER AND METHOD OF USE

(75) Inventors: Gangqiang Li, Palo Alto, CA (US); Hongfeng Yin, Cupertino, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 279 days.

(21) Appl. No.: 12/363,685

(22) Filed: Jan. 30, 2009

(65) Prior Publication Data

US 2010/0193702 A1 Aug. 5, 2010

(51) Int. Cl.
*H01J 49/10* (2006.01)

(52) U.S. Cl. ..... 250/288; 250/281; 250/282

(58) Field of Classification Search ..... 250/281, 250/282, 285, 288
See application file for complete search history.

(56) References Cited

U.S. PATENT DOCUMENTS 6,593,568 B1 * 7/2003 Whitehouse et al. ..... 250/288
6,998,722 B2 2/2006 Madurawe
7,078,681 B2 7/2006 Fischer et al.
7,173,240 B2 2/2007 Seaward et al.
7,204,431 B2 4/2007 Li et al.
7,259,379 B2 8/2007 Wang et al.
2002/0096631 A1 * 7/2002 Andrien et al. ..... 250/288
2004/0079881 A1 * 4/2004 Fischer et al. ..... 250/288
2009/0250608 A1 * 10/2009 Mordehai et al. ..... 250/288

OTHER PUBLICATIONS

Related to co-pending U.S. Appl. No. 12/023,524.
Related to co-pending U.S. Appl. No. 12/346,089.
Related to co-pending U.S. Appl. No. 11/932,835.
R.B. Cole, "Some tenets pertaining to electrospray ionization mass spectrometry" Journal of Mass Spectrometry 35, 763-772 (2000).
D.M. Lubman ed. "Lasers and Mass Spectrometry", Oxford University Press, 1990, pp. 223,231.

* cited by examiner

*Primary Examiner* — David A Vanore
*Assistant Examiner* — Nicole Ippolito Rausch

(57) ABSTRACT

An ion source a first ionizer comprising: an electrospray needle comprising a tip; and a conduit disposed annularly about the needle and configured to pass an inert gas in proximity of the tip to nebulize a fluid emerging from the tip, the nebulized fluid comprising analytes and a mobile phase. The ion source comprises a capillary in tandem with the first ionizer and configured to receive the droplets; a heater configured to heat the capillary to a temperature at which mobile phase vaporizes; and a second ionizer in tandem with the capillary and configured to receive the vaporized mobile phase and the analytes. A method is also described.

21 Claims, 5 Drawing Sheets

TANDEM IONIZER ION SOURCE FOR MASS SPECTROMETER AND METHOD OF USE

BACKGROUND

Chemical and biological separations are routinely performed in various industrial and academic settings to determine the presence and/or quantity of individual species in complex sample mixtures. There exist various techniques for performing such separations.

One particularly useful analytical process is chromatography combined with mass spectroscopy, which encompasses a number of methods that are used for separating ions or molecules for analysis. Liquid chromatography ('LC') is a physical method of separation wherein a liquid 'mobile phase' carries a sample containing one or more compounds for analysis (analytes) through a separation medium or 'stationary phase.' Liquid output by the LC device is nebulized to form droplets comprising the mobile phase and the analytes. Ideally, the mobile phase is removed, leaving the analytes. The analytes are provided to an ion source of a mass spectrometer (MS). Charged analytes are then provided to a mass analyzer for spectroscopic analysis.

Unfortunately, in known MS devices, among other problems, the percentage of analytes output from the LC column that are incident on a detector of the MS is comparatively small. For example, ionization can be incomplete, leaving the analytes only partially ionized. Furthermore, electrically-neutral analytes are not detected by the detector of the MS. Moreover, repulsion of analyte ions due to known space charge repulsion causes rarefaction. Decreased sample density translates to a comparatively small fraction of the sample ions entering the MS and, hence, reaching a detector in the MS. Ultimately, due to one or more of the noted factors, the overall efficiency of known MS devices is comparatively low.

What is needed, therefore, is a method and apparatus for providing analytes from an LC column to a mass analyzer that overcomes at least the drawbacks of known devices and methods described above.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

It is to be understood that the terminology used herein is for purposes of describing particular embodiments only, and is not intended to be limiting.

As used in the specification and appended claims, the terms 'a', 'an' and 'the' include both singular and plural referents, unless the context clearly dictates otherwise. Thus, for example, 'a device' includes one device and plural devices.

As used in the specification and appended claims, and in addition to their ordinary meanings, the terms 'substantial' or 'substantially' mean to with acceptable limits or degree. For example, 'substantially cancelled' means that one skilled in the art would consider the cancellation to be acceptable.

As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

Figure 1:
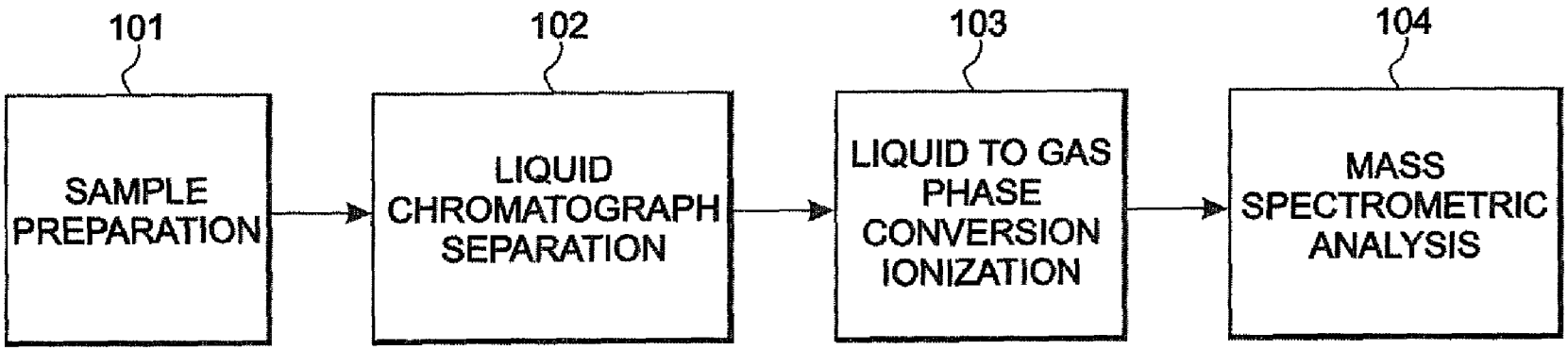
FIG. 1 shows a simplified block diagram of an LC-MS system in accordance with a representative embodiment.

FIG. 1 shows a simplified block diagram of an LC-MS system 100 in accordance with a representative embodiment. At section 101, sample preparation is completed using known devices and methods. In section 102, the sample is loaded into an LC apparatus, which comprises a separation medium. Illustratively, the apparatus used in section 102 may comprise a high pressure LC (HPLC) microfluidic device including a separation column. Section 103 comprises an apparatus that converts a fluid comprising a mobile phase and analytes into gas phase, and an ionizer that ionizes the analytes. The mobile phase is usefully vaporized leaving only the analytes. Ionizers of representative embodiments described below are provided in section 103. Section 104 comprises an apparatus used for mass spectroscopy. Section 104 comprises a mass analyzer, and hardware, software and firmware useful in the analysis of the analytes. As much of the apparatus of sections 101, 102 and 104 is known, details thereof are omitted to avoid obscuring the description of the representative embodiments. For example, the apparatus of section 102 may comprise HPLC apparatus described in commonly owned U.S. patent application Ser. No. 12/023,524 entitled "Microfluidic Device Having Monolithic Separation Medium and Method of Use" to Karla Robotti, et al. and filed on Jan. 31, 2008. The disclosure of this application is specifically incorporated herein by reference. Section 104 may comprise apparatus found in mass spectrometry equipment commercially available from Agilent Technologies, Inc., Santa Clara, Calif., USA, for example.

Figure 2:
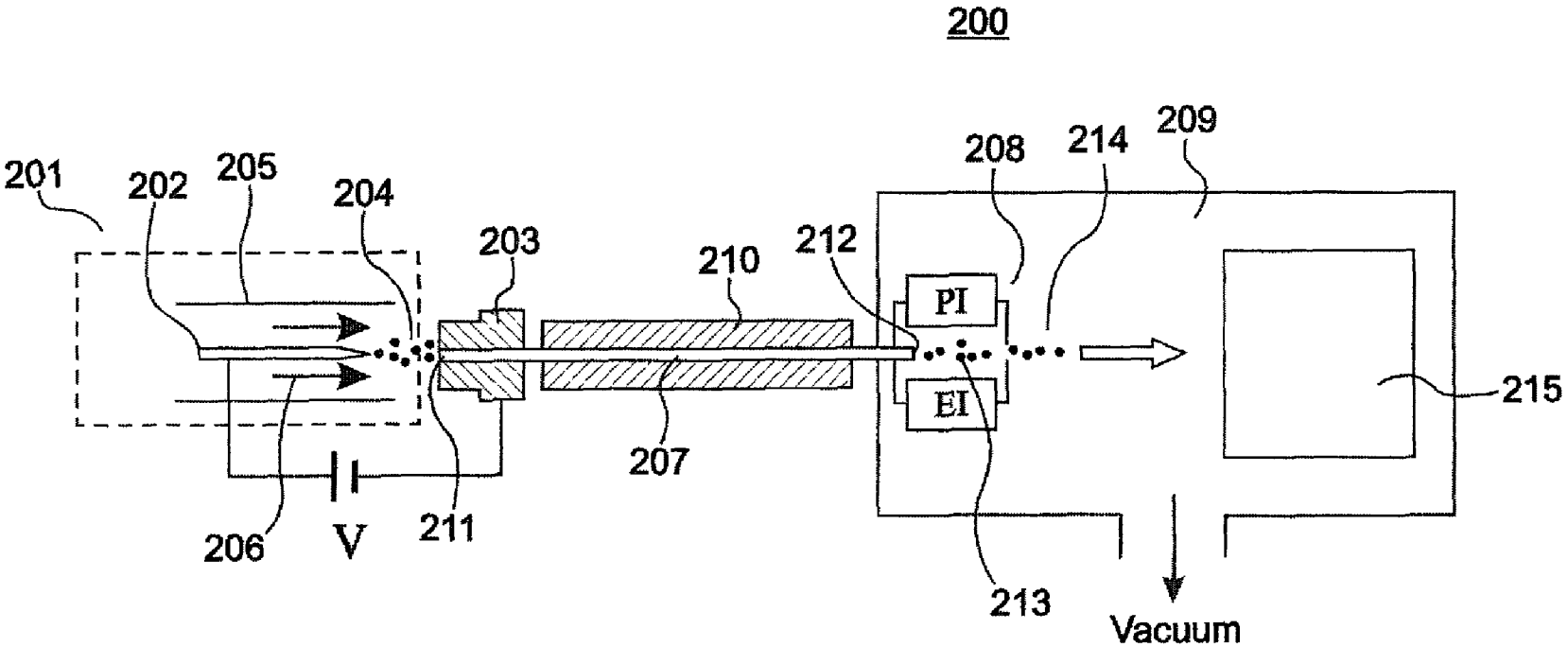
FIG. 2 shows a simplified schematic diagram of an ionizer in accordance with a representative embodiment.

FIG. 2 shows a simplified schematic diagram of an ion source 200 in accordance with a representative embodiment. The ion source 200 comprises a first ionizer 201 comprising an electrospray needle 202 that nebulizes fluid (not shown) comprising analytes and mobile phase from an LC column (not shown). Illustratively, the electrospray needle 202 is as described in commonly owned U.S. Pat. Nos. 7,173,240 and 7,204,431, the disclosures of which are specifically incorporated herein by reference.

As fluid emerges from the electrospray needle 201, an electrospray (not shown) is produced when a sufficient voltage (V) is applied between an inlet 203 and the fluid at the tip of the electrospray needle 202 to generate a concentration of electric field lines emanating from the tip of the electrospray needle 202. Illustratively, the voltage (V) has a magnitude in the range of approximately 1 kV to approximately 4 kV. Depending on the polarity of the voltage (V) applied, negatively charged analytes or positively charged analytes in the fluid will migrate to the surface of the fluid at the tip of the electrospray needle 202. Thus, the first ionizer 201 is configured to operate in a positive ionization mode to produce positively charged analytes or a negative ionization mode to produce negatively charged analytes by selecting the sign of the voltage (V). As is known, once the charged analytes are at the surface of the fluid, droplets 204 are created and under the influence of the electric field are driven by electrostatic forces towards the inlet 203 of the conduit.

The first ionizer 201 also comprises a conduit 205 provided annularly about the electrospray needle 202 to guide a gas 206, which is illustratively inert. Optionally, the gas 206 is heated to assist in nebulizing the fluid and to assist in desolvating the mobile phase of the droplets 204. The gas 206 is used to assist in nebulizing the fluid and is especially useful when the analytes are substantially electrically neutral or have weak dipole moments and thus are not readily nebulized by the electrospray needle 202. The gas 206 flows in the vicinity of the tip of the electrospray needle 202 and nebulizes the fluid to assist in forming the droplets 204. The gas 206 not only assists in the electrospray process to form droplets 204 that include charged analytes, but also nebulizes fluid to form droplets 204 that include neutral analytes and analytes with weak dipole moments. The conduit and the gas flow may be as described in U.S. Pat. No. 7,204,431; and as described in commonly owned U.S. patent application Ser. No. 12/346,089 entitled "Converging-Diverging Supersonic Shock Disruptor For Fluid Nebulization and Drop Fragmentation" to Harvey Loucks, et al., and filed Dec. 30, 2009. The respective disclosures of the '431 patent and the '089 patent application are specifically incorporated herein by reference.

The droplets 204 are forced by the electric field created by the voltage (V), or by the gas flow, or both, toward a capillary 207. As shown, the capillary 207 is connected to a second ionizer 208 disposed inside a vacuum chamber 209. In a region between the inlet 203 and the vacuum chamber 209, a heating element 210 is disposed annularly about the capillary 207. The annular arrangement of the heating element 210 is illustrative. Alternatively, a heating element is disposed in the capillary 207 to raise the temperature to vaporize the mobile. Still alternatively, the heating element may be provided in proximity to the capillary 207 to effect heating of the droplets 207. As the droplets 204 pass through the capillary 207 the heat generated by the heating element 210 imparts sufficient heat to cause the mobile phase to evaporate leaving desolvated gas and analytes in the capillary 207. The heating element 210 may be a known galvanic heater, a known thermoelectric effect device, or a known piezoceramic device. Illustratively, the heating element 210 heats the capillary 207 to a temperature selected in the range of approximately 50° C. to approximately 350° C. By heating the droplets 204 as they pass through the capillary 207, the heating element 210 provides a greater desolvation of the mobile phase. Beneficially, noise from a mass analyzer caused by incompletely desolvated droplets that are incident on the detector is reduced, while a greater percentage of analytes are completely desolvated are available to reach the mass analyzer.

The droplets 204 enter the capillary 207 at an inlet 211 and exit the capillary 207 at an outlet 212, which is disposed in the vacuum chamber 209. Because the vacuum chamber 209 is maintained at a comparatively low pressure, a pressure differential exits between the inlet 211 of the capillary 207 and the outlet 212 of the capillary 207. In addition to the momentum gained due to the flow of gas 206 and electrostatic attraction due to the voltage (V), the pressure differential between the inlet 211 and the outlet 212 forces the drops 204 through the capillary and into the second ionizer 208.

The capillary 207 has a diameter that is small compared to known drying chambers used to vaporize the mobile phase and desolvate analytes. Accordingly, the analyte ions that remain after desolvation of the mobile phase in the capillary 207 are confined to a comparatively small volume. As a result, the lateral extent of the analyte ions is beneficially restricted. Moreover, because some of the droplets 204 include only neutral analytes and these droplets not subject to space charge repulsion, a comparatively greater number of neutral analytes are transported from the electrospray needle 202 to the capillary 207 and then to the second ionizer 208. As such, a comparatively high density cloud of analytes 213 comprising neutral analytes and analyte ions is presented to the second ionizer 208. Ultimately, providing the analytes 213 in a comparatively higher density cloud serves to produce a greater ion current at the mass analyzer, which in turn leads to higher sensitivity and lower detection levels.

In a representative embodiment, the second ionizer 208 comprises one of a known electron impact (EI) ionizer, or a known photo-ionization (PI) source, or both. Illustratively, the EI ionizer is described in either of commonly owned U.S. Pat. Nos. 6,998,722 or 7,259,379, both entitled "On-Axis Electron Impact Ion Source" to Wang, et al. The PI source comprises one of a UV lamp, a UV laser, or a corona needle such as disclosed in commonly owned U.S. Pat. No. 7,078,681, entitled "Multimode Ionization Source" to Fischer, et al. Alternatively, the PI source may be a microplasma UV source such as described in commonly-owned U.S. patent application Ser. No. 11/932,835, entitled "Micro-plasma Illumination Device and Method" to Viorica Lopez-Avila, et al. and filed Oct. 31, 2007. The disclosures of the '681 patent and the '835 patent application are specifically incorporated herein by reference.

The second ionizer 208 may be operated in either positive ionization mode (to produce positively charged analytes) or negative ionization mode (to produce negatively charged analytes). Moreover, the first ionizer 201 and the second ionizer 208 are configured to function in the same polarity ionization mode or opposite polarity ionization mode. Illustratively, in one embodiment the first ionizer 201 may be operated in a positive ionization mode and the second ionizer 208 may be operated in a negative ionization mode. Beneficially, by configuring the ionizers 201, 208 to operate in opposite polarity ionization modes, complementary information can be obtained about the analytes of a sample from both positive analytes and negative analytes. In yet another embodiment, the second ionizer 208 can be selectively deactivated to avoid fragmenting analytes of a sample.

As mentioned above, the second ionizer 208 is provided in the vacuum chamber 209 and therefore is maintained at a low pressure, substantially at vacuum. Illustratively, the pressure of the vacuum chamber 209 is maintained at a pressure in the range of approximately $10^{-4}$ Torr to approximately $10^{-10}$ Torr. The second ionizer 208 provides several useful functions. The second ionizer 208 ionizes analytes that are not ionized by the first ion electrospray process, and thus would remain neutral analytes that otherwise would go undetected. Moreover, for various reasons some analytes may be only partially ionized by the electrospray process. The second ionizer 208 beneficially ionizes the neutral analytes and increases the ionization of the analytes that are only partially ionized by the electrospray process. Furthermore, by selecting the appropriate electron or UV energy, second ionizer 208 can be configured to fragment certain analytes into constituent molecules. These fragmented molecules are incident on the mass analyzer and the detector and data related to the structure of the analytes can be obtained that would not be revealed without fragmentation. Finally, by fragmenting some or all of the analytes, the second ionizer 208 can provide positively charged and negatively charged ions to the detector without requiring the voltage (V) to be changed.

In operation, after emerging from the capillary 207, the analytes are provided to the second ionizer 208 where selectively: neutral analytes are ionized, charged analytes are further ionized, and certain analytes are fragmented by the second ionizer 208. Analyte ions 214 emerge from the second ionizer 208 and comprise one or more of the ionized neutral ions, charged analytes that are further ionized and fragmented analytes. The analyte ions 214 are incident on a mass analyzer 215 provided in the vacuum chamber 209. The ions 214 are incident on the mass analyzer 215 directly or via ion optics (not shown). In representative embodiments, the mass analyzer comprises: a quadrupole mass filter; a time of flight mass spectrometer (TOFMS); a Fourier transform ion cyclotron resonance (FT-ICR) mass analyzer; or an ion trap. Notably, the mass analyzer 215 may comprise a combination of two or more of these devices.

Figure 3:
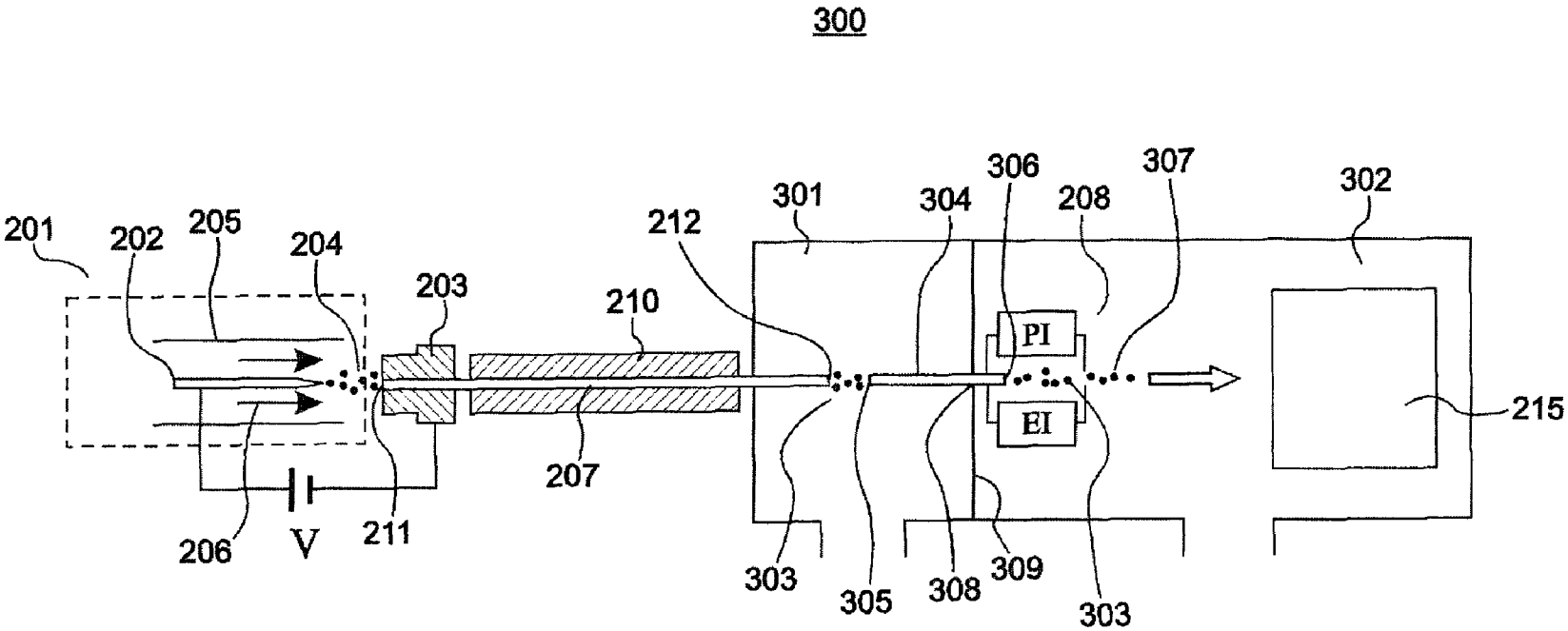
FIG. 3 shows a simplified schematic diagram of an ionizer in accordance with a representative embodiment.

FIG. 3 shows a simplified schematic diagram of an ion source 300 in accordance with a representative embodiment. The ion source 300 shares many common components and attributes described above in connection with the embodiments of FIG. 2. These details are not repeated in order to avoid obscuring the description of the embodiments of FIG. 3.

The ion source 300 comprises a first vacuum chamber 301 and a second vacuum chamber 302. The second ionizer 208 is provided in the second vacuum chamber 302. The capillary 207 expels analytes 303 from outlet 212 along with mobile phase vapor (not shown). The first vacuum chamber 301 reduces the volume of vapor that is transferred to the second ionizer 208 and the second vacuum chamber 302. Beneficially, this reduces the load on the second ionizer 208 and the mass analyzer 215 by preventing the comparatively high flow of mobile phase vapor from entering the second vacuum chamber 302. Moreover, reducing the mobile phase vapor at the mass analyzer beneficially reduces the noise in the mass spectra.

After substantially removing vapor from the mobile phase in the first vacuum chamber 301, analytes 303 are provided to another capillary 304. The capillary 304 extends through an opening 308 in the wall 309 between the first vacuum chamber 301 and the second vacuum chamber 302. The opening 308 has a diameter that is substantially the same as the diameter of the capillary 304 to ensure a proper seal and to prevent unintended transfer of analytes and vapors. The capillary 304 comprises and inlet 305 and an outlet 306. The outlet 306 extends into to the second ionizer 208. After emerging from the outlet 306, the analytes 303 are ionized by either EI or PI at the second ionizer 208, and analytes 307 emerge and are directed to the mass analyzer 215 as shown.

The inlet 305 is spaced from the outlet 212 of capillary 207 to promote removal of vapor of the mobile phase after passing droplets 204 through capillary 207. Beneficially, removing vapor prevents the vapor from being transferred to the mass analyzer 215 and thereby reduces noise. However, the spacing between the outlet 212 and the inlet 305 cannot be too great to avoid loss of analytes 303. By contrast, if the spacing is too small, the vapor removal is inefficient, and the vapor throughput to the second vacuum chamber 302 is too great. This requires a greater pumping capacity to remove the vapor at the second vacuum chamber 302. The greater pumping capacity can increase the cost of the ion source 300 and yet not remove the vapor sufficiently to maintain the noise at the mass analyzer 215 to an acceptable level. In representative embodiments, the spacing between the outlet 212 and the inlet 305 is in the range of approximately 1 mm to approximately 10 mm.

Illustratively, the capillary 207 and the capillary 304 each have a diameter in the range of approximately 0.1 mm to approximately 1.0 mm. The capillary 304 may be have a larger diameter than the capillary 207; or have a smaller diameter than the capillary 207; or have the same diameter as the capillary 207. The diameters of the capillaries 207,304 are based on considerations including throughput and requirements of the pump to attain vacuum. In particular, a greater diameter increases the number of drops 204 that will ultimately reach the second ionizer 208. However, larger diameter capillaries require pumps with larger pumping capacity in both the first and the second vacuum chambers 301, 302 to handle the increased volume and will increase the cost of the ion source 300. Moreover, the flow of droplets 204 may become turbulent due to the increased capacity of the pumps. By creating an impediment to the flow through the capillaries 207, 304, this turbulence can decrease the throughput of analytes through the capillaries 207, 304. Thus, the desired increased throughput from the increased capillary diameters and pumping capacity can actually be reduced.

In another representative embodiment, capillary 304 is foregone and analytes 303 travel through the opening 308 and into the second vacuum chamber 302. In this embodiment, the capillary 207 is extended into the first vacuum chamber 301 so that the outlet 212 is spaced a distance in the range of approximately 1 mm to approximately 10 mm from the opening. The analytes 303 exit the outlet 212 as described in above and vapor from the mobile phase is pumped off in the vacuum chamber 301. However, rather than enter the inlet 305, the analytes 303 pass through the opening 308. Just as the distance between the outlet 212 and the inlet 305 was selected to be large enough for significant vapor removal and small enough to avoid significant loss of analytes, the distance between the outlet 212 and the opening 308 is selected for substantially the same reasons. In an embodiment, the opening 308 has a diameter in the range of approximately 0.1 mm to approximately 1.0 mm. Just like the selection of the diameters of the capillaries 207, 304, the selection of the aperture is based on considerations including throughput and requirements of the pump to attain vacuum.

Figure 4:
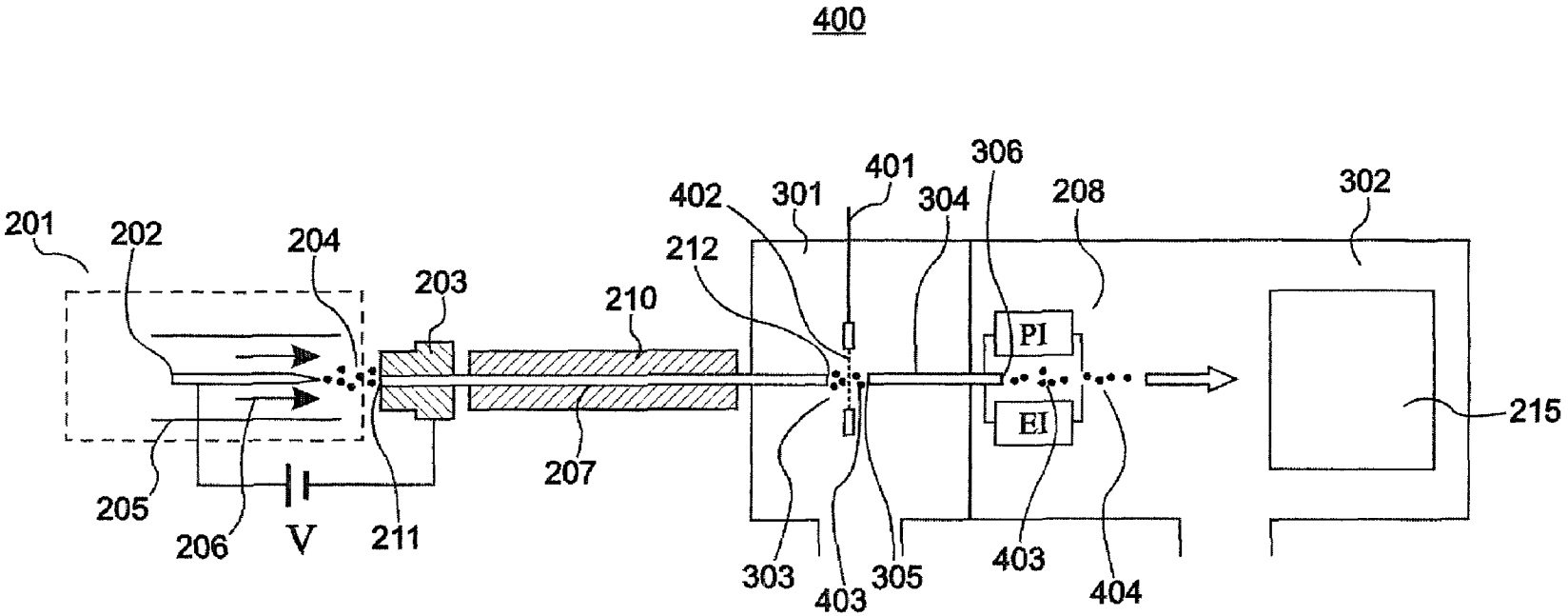
FIG. 4 shows a simplified schematic diagram of an ionizer in accordance with a representative embodiment.

FIG. 4 shows a simplified schematic diagram of an ion source 400 in accordance with a representative embodiment. The ion source 400 shares many common components and attributes described above in connection with the embodiments of FIGS. 2 and 3. These details are not repeated in order to avoid obscuring the description of the embodiments of FIG. 4.

The ion source 400 comprises a charge blocking grid 401 disposed between the first ionizer 201 and the second ionizer 208. In an embodiment, the charge blocking grid 401 is provided in the first vacuum chamber 301, as shown in FIG. 4. Alternatively, in an embodiment having one vacuum chamber, such as shown in FIG. 1, the charge blocking grid 401 is provided in the vacuum chamber between the outlet 212 of the capillary 207 and the second ionizer 208.

In a representative embodiment, the charge blocking grid 401 comprises an electrically conductive mesh 403 with openings (not shown) sufficiently large to allow neutral analytes to pass comparatively unimpeded through the mesh 402.

A voltage having the same polarity as the voltage (V) applied in first ionizer 201 is applied to the charge blocking grid 401 with a sufficient magnitude to substantially prevent ions having a charge of the same polarity as the voltage applied to the charge blocking grid 401 from traveling past the grid 401 and to the second ionizer 208. Alternatively, rather than providing the blocking voltage via the conductive mesh 402, the voltage is applied between the outlet 212 of capillary 207 and the inlet 305 of capillary 304. In this embodiment, the capillaries 207, 304 are made of an electrically conductive material or are coated with an electrically conductive material in order to establish the voltage.

Analytes 303 emerge from the outlet 212 of the capillary 207 as described above. The charge blocking grid 401 usefully passes neutral analytes 403 to the second ionizer 208 and prevents ionized analytes of the same polarity as the voltage applied to the grid 401 from passing the grid 401. Rather, the neutral analytes 403 are ionized at the second ionizer 208 and emerge as analyte ions 404. The analyte ions 404 are passed to the mass analyzer 215.

In this mode, the data from the MS will show the spectra of analytes that emerge from the first ionizer 201 substantially electrically neutral and are ionized by EI or PI at the second ionizer 208. Thus, complementary data can be obtained. For example, if two analyte compounds have a similar mass and mass-to-charge ratio, but one is polar or more easily ionized, without blocking one at the charge blocking grid 401, their mass spectra could overlap. By passing the analytes that emerge from the first ionizer 201 substantially uncharged and blocking the analytes that emerge from the first ionizer 201 charged, the two species can be more easily discerned spectrally.

Figure 5:
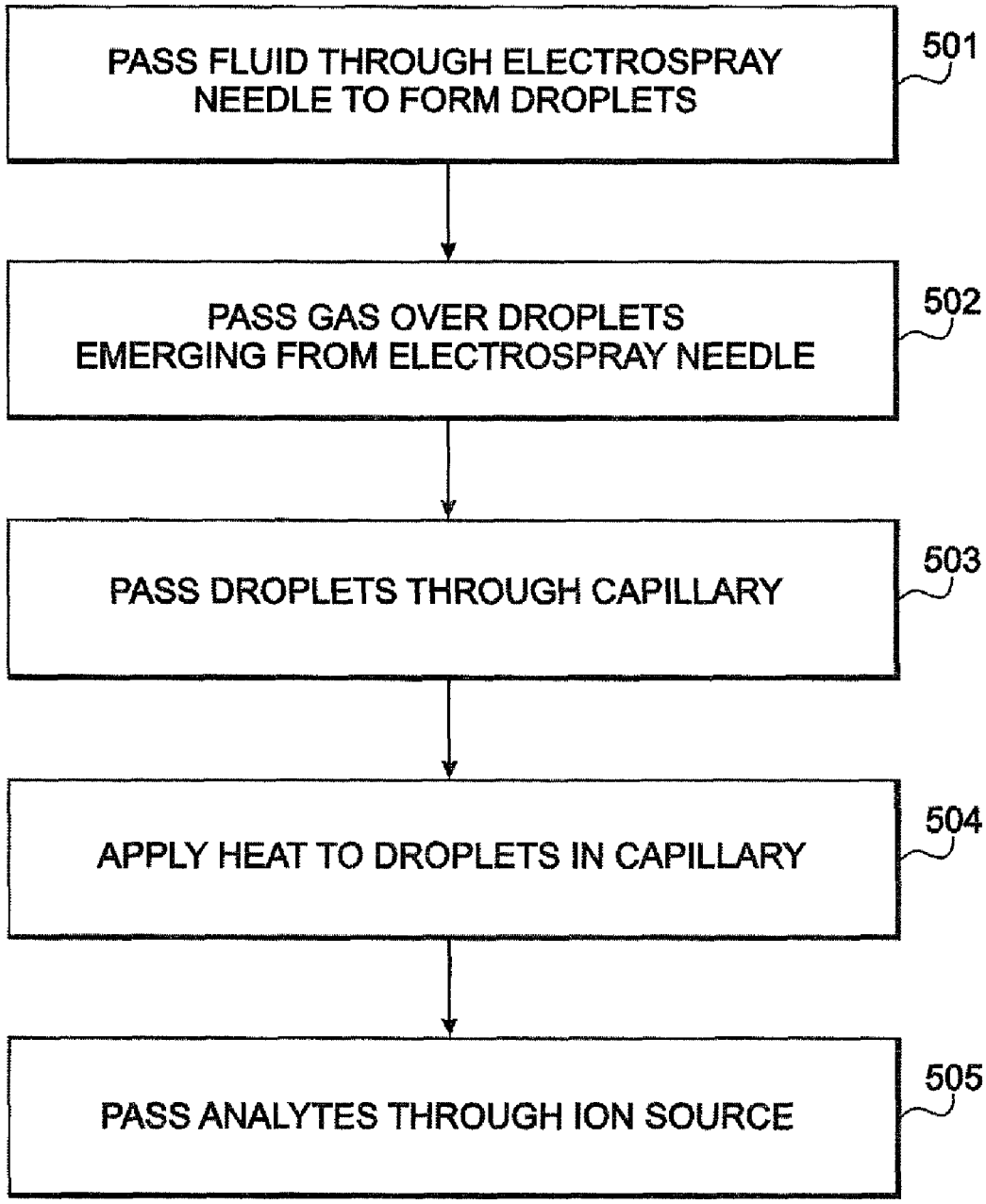
FIG. 5 shows a flow-chart of a method in accordance with a representative embodiment.

FIG. 5 shows a flow-chart of a method 500 in accordance with a representative embodiment. The method is implemented in conjunction one of the ion sources 200, 300, 400 and therefore shares many common components and attributes described above in connection with the embodiments of FIGS. 2, 3 and 4. These details are not repeated in order to avoid obscuring the description of the embodiments of FIG. 5.

In accordance with a representative embodiment, the method 500 comprises at 501 passing a fluid comprising a mobile phase and analytes through electrospray needle 202 to form droplets 204 of the fluid. At 502, the method comprises passing gas 206 over the droplets 204 emerging from the electrospray needle. At 503, the method comprises passing the droplets 204 through capillary 207. At 504, the method comprises applying heat to the droplets passing through the capillary to substantially vaporize the mobile phase. At 505 the method comprises passing the analytes to the second ionizer to ionize the analytes.

In view of this disclosure it is noted that the methods and devices can be implemented in keeping with the present teachings. Further, the various components, materials, structures and parameters are included by way of illustration and example only and not in any limiting sense. In view of this disclosure, the present teachings can be implemented in other applications and components, materials, structures and equipment to needed implement these applications can be determined, while remaining within the scope of the appended claims.

The invention claimed is:

1. An ion source, comprising:

a first ionizer comprising: an electrospray needle comprising a tip; and a conduit disposed annularly about the needle and configured to pass an inert gas in proximity of the tip to nebulize a fluid emerging from the tip, the nebulized fluid comprising analytes and a mobile phase;

a capillary in tandem with the first ionizer and configured to receive the droplets;

a heater configured to heat the capillary to a temperature at which mobile phase vaporizes; and a second ionizer in tandem with the capillary and configured to receive the vaporized mobile phase and the analytes.

2. An ion source as claimed in claim 1, wherein the analytes comprise charged analytes and neutral analytes.

3. An ion source as claimed in claim 1, wherein the second ionizer comprises an electron impact ionizer.

4. An ion source as claimed in claim 1, wherein the second ionizer comprises a light source adapted to ionize the analytes.

5. An ion source as claimed in claim 1, wherein the second ionizer comprises a corona needle.

6. An ion source as claimed in claim 1, further comprising a vacuum chamber, wherein the second ionizer is disposed in the vacuum chamber.

7. An ion source as claimed in claim 1, further comprising a charge blocking grid disposed between the first ionizer and the second ionizer, the charge blocking grid configured to substantially prevent charged analytes from passing to the second ionizer and to pass neutral analytes to the second ionizer.

8. An ion source as claimed in claim 1, further comprising:

a first vacuum chamber and a second vacuum chamber in tandem, wherein the second ionizer is disposed in either the first vacuum chamber or the second vacuum chamber.

9. An ion source as claimed in claim 1, wherein the capillary comprises an outlet, and the ion source further comprises:

a first vacuum chamber;

a second vacuum chamber in tandem with the first vacuum chamber;

a second capillary comprising an inlet disposed in the first vacuum chamber and an outlet disposed in the second vacuum chamber; and a gap between the outlet of the capillary and the inlet of the second capillary.

10. An ion source as claimed in claim 1, wherein the capillary comprises an outlet, and the ion source further comprises:

a first vacuum chamber;

a second vacuum chamber in tandem with the first vacuum chamber;

an opening between the first vacuum chamber and the second vacuum chamber; and a gap between the outlet of the capillary and the opening.

11. An ion source as claimed in claim 1, further comprising:

a first vacuum chamber;

a second vacuum chamber in tandem with the first vacuum chamber, wherein the second ionizer is disposed in the second vacuum chamber; and a charge blocking grid disposed in the first vacuum and between the first ionizer and the second ionizer, the charge blocking grid adapted to substantially prevent charged analytes from passing to the second ionizer and to pass neutral analytes to the second ionizer.

12. An ion source as claimed in claim 1, wherein the first ionizer is configured to function in a first ionization mode and the second ionizer is configured to function in a second ionization mode.

13. An ion source as claimed in claim 12, wherein the first ionization mode and the second ionization mode are of a same polarity.

14. An ion source as claimed in claim 12, wherein the first ionization mode and the second ionization mode are of an opposite polarity.

15. In an ion source comprising a first ionizer, comprising an electrospray needle; and a second ionizer in tandem with the first ion source, a method, comprising:

passing a fluid comprising a mobile phase and analytes through the electrospray needle to form droplets of the fluid;

passing a gas over the droplets emerging from the electrospray needle;

passing the droplets through a capillary;

applying heat to the droplets passing through the capillary to substantially vaporize the mobile phase; and passing the analytes to the second ionizer.

16. A method as claimed in claim 15, wherein the second ion source comprises an electron impact ionizer.

17. A method as claimed in claim 15, wherein the second ion source comprises a light source.

18. A method as claimed in claim 15, wherein the light source comprises a corona needle.

19. A method as claimed in claim 15, wherein the analytes comprise charged analytes and uncharged analytes, and the second ionizer substantially ionizes the uncharged analytes.

20. A method as claimed in claim 15, further comprising, after the heating of the droplets and before passing the vaporized mobile phase and analytes to the second ionizer, separating charged analytes from uncharged analytes.

21. A method as claimed in claim 20, wherein only the uncharged analytes are passed to the second ionizer.

* * * * *